United States Patent [19]

Fariss, Jr.

[11] 4,134,209

[45] Jan. 16, 1979

[54] DEVICE AND METHOD FOR MEASURING COIN DIE ROTATION ERROR

[75] Inventor: James D. Fariss, Jr., Wilmington, Del.

[73] Assignee: Innovation Enterprises, Inc., Wilmington, Del.

[21] Appl. No.: 894,998

[22] Filed: Apr. 10, 1978

[51] Int. Cl.[2] ..... G07F 3/02

[52] U.S. Cl. ..... 33/1 N; 73/163

[58] Field of Search ..... 73/163; 33/1 N, 1 BB, 33/174 R, 191, 174 N, 174 G; 408/75, 16, 85, 86, 115

[56] References Cited

U.S. PATENT DOCUMENTS

| | | | |
|---|---|---|---|
| 3,349,612 | 10/1967 | Sherman | 73/163 |
| 3,690,012 | 9/1972 | Barna | 33/191 |
| 3,728,795 | 4/1973 | Von Camber | 73/163 |
| 4,058,820 | 6/1976 | Hollen | 73/163 |

*Primary Examiner*—Donald Watkins
*Assistant Examiner*—Denis E. Corr

[57] ABSTRACT

A device and a method for measuring the die rotation error of coins, which error occurs during the process of coining money, are disclosed. Die rotation error is one factor which determines the worth of coins to coin collectors, and this invention provides rapid and accurate means for determining such errors.

4 Claims, 6 Drawing Figures

DEVICE AND METHOD FOR MEASURING COIN DIE ROTATION ERROR

BACKGROUND OF THE INVENTION

During the coining process of money, die rotation can, and often does, occur, resulting in the orientation of the reverse face (tail) of the coin to be rotated somewhat from the orientation of the obverse (head) of the coin. In such coining process, the dies used are hardened steel tools which impress the desired image on a coin blank. The dies are used in pairs, coining the obverse face and the reverse face of a coin simultaneously, in a machine referred to as a stamping press. By design, the obverse face and reverse face are intended to be 180° out of phase. However, one or both of the dies may become loose in its fixture and rotate, causing the image on one side of the coin to be offset from the theoretical or "perfect" 180° obverse-to-reverse relationship. This offset is called die rotation error.

In the numismatic industry (coin collecting), the value of a given coin is increased in proportion to the degree of its die rotation error, the frequency (or lack thereof) of such error in a given issue, and the rarity of the coin itself. At present, there are no methods known to measure die rotation error other than to place the coin on a circular scale, mark the edge of the coin, and then turn the coin over keeping the mark at the same position on the scale and estimate the amount of rotation. Alternatively, an elaborate and cumbersome system of mirrors and scales, arranged so that one may simultaneously see both sides of the coin, may be used. However, numismatists do not like to mark their valuable coins, and mirror and scale devices are unwieldy and inconvenient.

Certain die rotation errors have been cataloged. For example, "The Major Variety and Oddity Guide to United States Coins", 5th Edition, Library of Congress Catalog Card No. 67-18968, lists the following:

1966 Nickel, rotated 15°, 30° 60°, 70°, 90°
1960 Dime, rotated 20°
1930P Nickel, rotated 60°
1926D Cent, rotated 345°
1924P Cent, rotated 10°, 35°, 45°, 60°, 180°, 240°

Certain earlier-dated coins possessed the following rotation errors:

1798 Large cent, rotated 90°
1809 Half cent, rotated 160°
1816 Cent, rotated 310°

There is provided according to this invention a device for quickly, accurately and conveniently measuring the die rotation error for any given coin without marking or disturbing the coin in any way. The device is compact, easily portable, and may be carried in one's pocket such that a numismatist visiting a coin show may obtain on-the-spot measurements of rotation error of coins he may wish to add to his collection.

SUMMARY OF THE INVENTION

A device and method for measuring the die rotation error of a coin are provided. The device comprises a case member having a front face and a rear face and having a plurality of concentric circular markings on the front face thereof, and a rotatable member located in the rear face of the case and oriented such that the center of the rotatable member aligns with the centers of the concentric circular markings, the rotatable member having indicator means for measuring angle of rotation, and a slide member adapted to slide into the case member, the slide member possessing a "V"-slot adapted to accept coins up to about 2 inches in diameter, the case member, rotatable member and slide member all being constructed of clear plastic or glass, such that, when a coin is placed in the slide in the "V"-slot and the obverse face of the coin is aligned vertically, and the slide is inserted into the case such that the obverse face of the coin is centered within the concentric circular markings, and the so aligned case, slide and coin are turned over, and the indicator of the rotatable member is aligned with the vertical axis of the reverse side of the coin, the degree of die rotation error of the coin is thereby measured.

BRIEF DESCRIPTION OF THE DRAWINGS

It will be apparent to one reading this disclosure that FIG. 1 taken together with FIG. 3 show front and rear views of a coin having no offset error, while FIG. 1 taken together with FIG. 6 show front and rear views of a different coin having a 30° offset error. FIG. 1 has not been shown twice for convenience.

DETAILED DESCRIPTION OF THE INVENTION

The device of this invention quickly and accurately measures the die rotation error possessed by certain coins. The die rotation error results during the coining of money when the clamping mechanism holding the stamping dies becomes loose. While it is as probable that the top die striking the obverse face of the coin can become loose as the bottom die striking the reverse face, it is industry standard to assume that the top die was positioned correctly and the bottom die loosened, causing the error. It is also assumed in the industry that offset error always occurs clockwise. Hence, an actual stamping error of 15° counterclockwise would be considered to be a die rotation error of the reverse die of 345°.

The detailed description of the device of this invention will be better understood with reference to the drawings.

Figure 1:
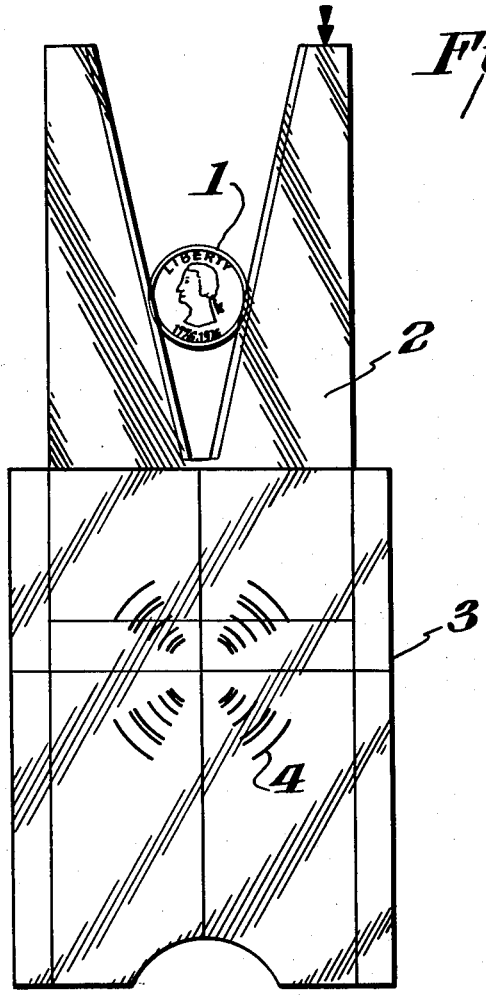
FIG. 1 shows a front view of the device of this invention, including coin 1 placed in the "V"-slot of slide member 2, slide member 2 being inserted into case member 3.
Figure 5:
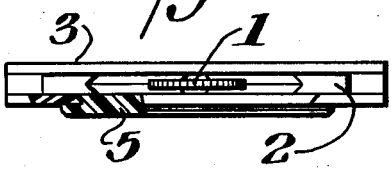
FIG. 5 shows a top view of the device of this invention.
Figure 2:
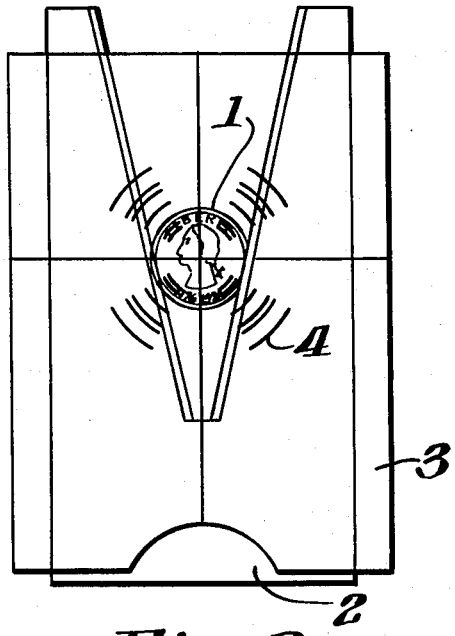
FIG. 2 shows slide member 2 positioned into case member 3 in such a way that the outside diameter of coin 1 coincides with one of several positioning circles 4 located on the front face of case 3, thereby positioning and centering the coin at the center of rotating member 5.
Figure 4:
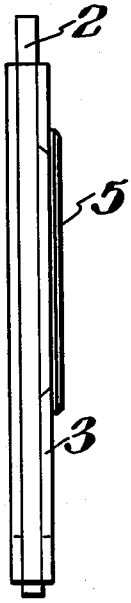
FIG. 4 is a side view of the device of this invention showing slide member 2, case member 3 and rotating member 5.

Coin 1 is shown in FIG. 1 placed in the "V"-slot of slide member 2. The "V"-slot is constructed to accept any standard size coin having diameters from ¼ to 2 inches, and thickness up to about ⅛ inch. The combination of the "V"-slot of slide member 2 with its also "V"-notched tapered sides, shown in FIG. 5, permits any coin to be inserted and centered on the vertical axis of its obverse side.

After the coin is positioned in the "V"-slot and vertically oriented, slide member 2 is pushed into case 3 and the outer diameter of the coin is aligned with one of the several circular indexing lines 4 which are marked on case 3 and which correspond to the diameters of all U.S. coins. These outer diameters for U.S. coins are 0.700, 0.800, 0.950, 1.200, 1.500 and 2.000 inch.

Figure 6:
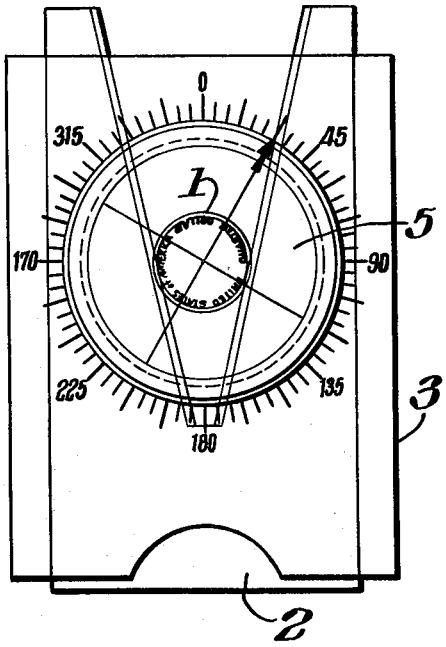
FIG. 6 shows a rear view of the device of this invention showing the reverse face of coin 1 in center alignment with rotating member 5. The coin shown in FIG. 6 is offset by 30° from perfect alignment, obverse to reverse, when compared to FIG. 1, and rotating member 5 is shown rotated appropriately to accurately indicate this 30° offset error. Slide member 2, case member 3 and rotating member 5 are all constructed of clear plastic or glass to permit visual alignment and observation of coin 1.
Figure 3:
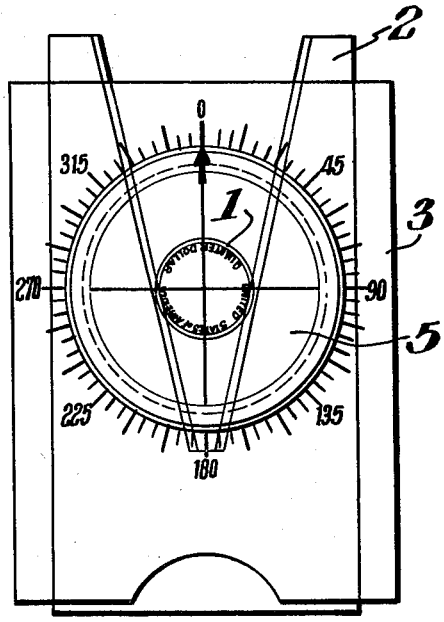
FIG. 3 shows a rear view of the device of this invention showing the reverse face of coin 1 in center alignment with rotating member 5. The coin shown in FIG. 3 is in perfect 180° out-of-phase alignment obverse to reverse, when compared to FIG. 1.

When the coin has been so aligned, the device is turned over as shown in FIGS. 3 and 6. Rotating member 5, now in center alignment with coin 1, possesses a suitable scale thereon for measuring angle of rotation. For example, rotating member 5 is shown to have cross-hairs and an arrow indicator, and case 3 is shown to have a scale from 0° to 360° marked thereon around the diameter of rotating member 5. By rotating the rotating member 5 clockwise until the cross-hairs line up with the vertical and horizontal axes of the reverse face of coin 1, the degree of rotational error is shown by the indicating arrow.

Taking FIG. 1 together with FIG. 3, a coin having zero offset is shown.

Taking FIG. 1 together with FIG. 6, a coin having 30° offset is shown.

The invention has been disclosed herein in connection with certain embodiments and structural and procedural details. However, it is clear that changes, modifications or equivalents can be used by those skilled in the art and, accordingly, such changes within the principles of the invention are intended to be included within the scope of the claims below.

I claim:

1. A device for measuring the die rotation error of a coin comprising:

(a) a case member having a front face and a rear face and having a plurality of concentric circular markings on said front face and having (b) a rotatable member in said rear face oriented such that the center of said rotatable member aligns with the centers of said circular markings, said rotatable member having an indicator for measuring angle of rotation; and (c) a slide member adapted to slide into said case member, the slide member possessing a "V"-slot adapted to accept coins up to about 2 inches in diameter, said case, rotatable and slide members being constructed of clear plastic, such that, in use of said device, a method of measurement of die rotation error is provided when a coin is placed in said slide in the "V"-slot and the obverse face of the coin is aligned vertically, and said slide is inserted into said case such that the obverse side of the coin is centered within the concentric circular markings, and the so-aligned case, slide and coin are turned over, and said indicator of the rotatable member is aligned with the vertical axis of the reverse side of said coin, the degree of die rotation error of the coin thereby being measured.

2. The device of claim 1 constructed of glass.

3. The device of claim 1 constructed partly of plastic and partly of glass.

4. The method of measuring the die rotation error of a coin using the device of claim 1.

* * * * *